US005163548A

United States Patent [19]

Domansky

[11] Patent Number: 5,163,548

[45] Date of Patent: Nov. 17, 1992

[54] PACKAGE INCORPORATING FLANGED CONTAINERS

[75] Inventor: Philippe Domansky, Châteauroux, France

[73] Assignee: The Mead Corporation, Dayton, Ohio

[21] Appl. No.: 867,936

[22] Filed: Apr. 13, 1992

Related U.S. Application Data

[63] Continuation of Ser. No. 729,263, Jul. 12, 1991, abandoned.

[51] Int. Cl.[5] ..... B65D 75/00

[52] U.S. Cl. ..... 206/158; 206/155; 206/147; 206/429; 206/434; 229/40

[58] Field of Search ..... 206/145, 147, 148, 151, 206/154, 155, 156, 158, 427, 429, 434; 229/40

[56] References Cited

U.S. PATENT DOCUMENTS

| | | | |
|---|---|---|---|
| 2,764,284 | 9/1956 | Arneson | 206/147 |
| 2,943,427 | 7/1960 | Fisher | 206/434 |
| 3,005,546 | 10/1961 | Sanford | 206/434 |
| 3,151,802 | 10/1964 | Spery | 206/155 |
| 3,252,649 | 5/1966 | Graser et al. | 206/155 |
| 3,398,856 | 8/1968 | Graser | 206/148 |
| 3,679,121 | 7/1972 | Morgese | 206/155 |
| 3,701,181 | 10/1972 | Lock | 206/434 |
| 3,756,394 | 9/1973 | Huault | 206/148 |
| 3,828,926 | 8/1974 | Rossi | 229/40 |
| 4,215,781 | 8/1980 | Humphries et al. | 229/40 |
| 4,273,273 | 6/1981 | Zenri | 206/145 |
| 4,451,001 | 5/1984 | Webinger | 229/40 |
| 4,671,453 | 6/1987 | Cassidy | 229/40 |
| 4,732,316 | 3/1988 | Oliff et al. | 229/40 |
| 4,773,540 | 9/1988 | Schuster | 229/40 |
| 4,804,089 | 2/1989 | Wilson | 206/147 |
| 4,832,257 | 3/1989 | Wood | 229/40 |
| 4,925,019 | 5/1990 | Ganz et al. | 206/145 |
| 5,000,313 | 3/1991 | Oliff | 229/40 |
| 5,060,792 | 10/1991 | Oliff | 206/427 |
| 5,092,467 | 3/1992 | Elward | 229/40 |

FOREIGN PATENT DOCUMENTS

| | | | |
|---|---|---|---|
| 262741 | 11/1962 | Australia | 229/40 |
| 618577 | 4/1961 | Canada | 206/156 |
| 1424536 | 12/1965 | France | 229/40 |
| 1444157 | 5/1966 | France | 206/148 |
| 2298489 | 8/1976 | France . | |
| 716985 | 10/1966 | Italy | 206/154 |
| 984450 | 2/1965 | United Kingdom . | |
| 1319902 | 6/1973 | United Kingdom | 206/427 |
| 1380240 | 1/1975 | United Kingdom | 206/434 |

*Primary Examiner*—David T. Fidei
*Attorney, Agent, or Firm*—Erwin Doerr

[57] ABSTRACT

A package (AC) which accommodates at least one cup having top flanges includes a carrier comprising a top panel (12) overlying the top ends of each cup, side wall panels (14, 16) depending from and hinged to opposed side edges of the top wall and end wall constructions (W, W1) at each of the two other opposed side edges of the top wall. The carrier is held in its completed form to retain each cup therein by cooperation between each of the end wall constructions and the adjacent cup and by retaining slots (22, 24; 26, 28) to maintain each of the cups in cooperation with the end wall constructions.

7 Claims, 2 Drawing Sheets

FIG. 1
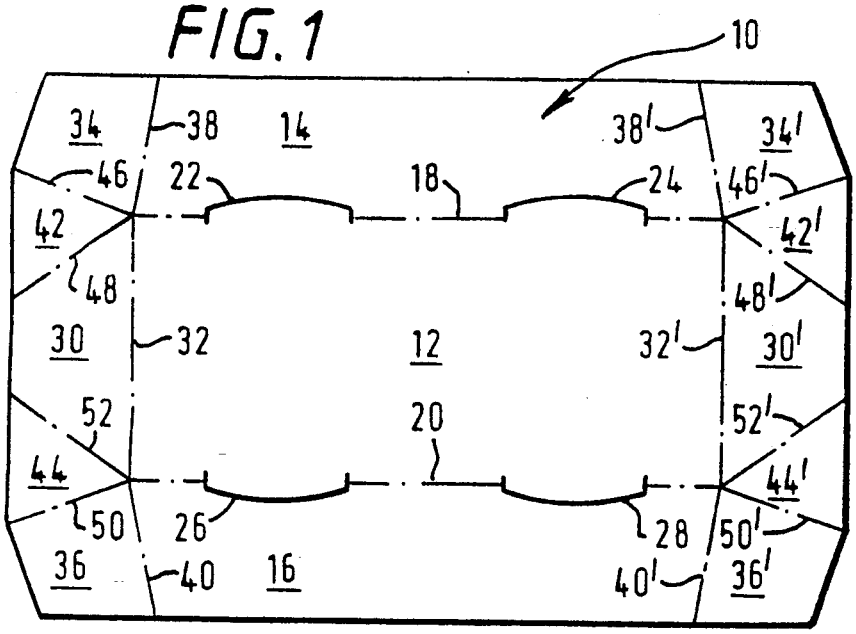
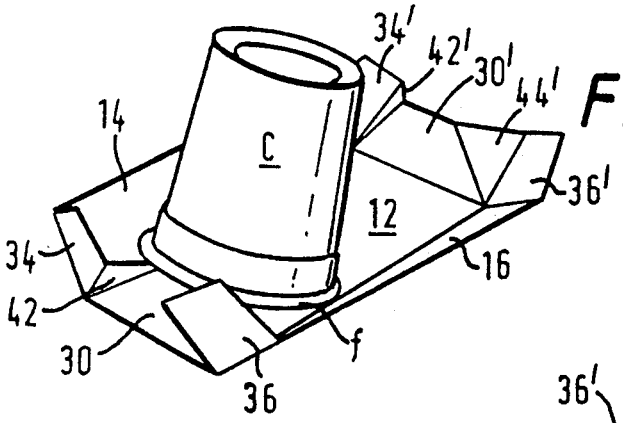
FIG. 2
FIG. 3
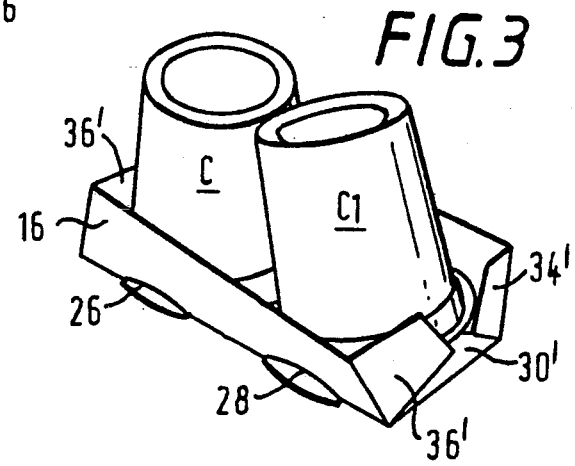
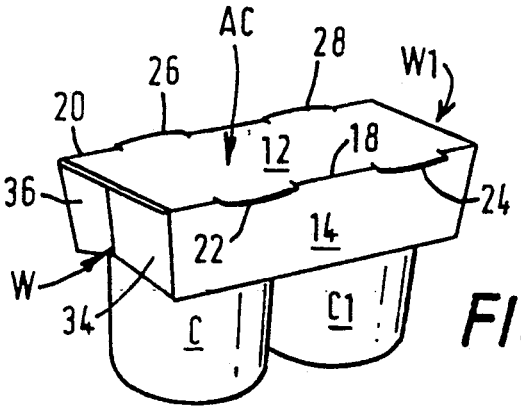
FIG. 4

PACKAGE INCORPORATING FLANGED CONTAINERS

This application is a continuation of application Ser. No. 07/729,263, filed Jul. 12, 1991, now abandoned.

FIELD OF THE INVENTION

This invention relates to a package which incorporates at least one container having a top flange which receives the container lid. More usually a package according to the invention takes the form of an article carrier which holds a plurality of such containers together in a group.

SUMMARY OF THE INVENTION

The package or article carrier is formed from a blank of foldable sheet material such as paperboard and is formed into a top-gripping "clip". Setting up the clip from a flat blank is completed by the introduction of the or each article with which it is to receive and thereafter each article cooperates with portions of the paperboard material to hold it in its completed form thereby despensing with the need for glue or other secondary securing means.

The invention provides a package which accommodates at least one article which package comprises a carrier having a top panel overlying the top end of each article, side wall panels depending from and hinged to opposed side edges of said top wall and an end wall construction at each of two other opposed side edges of said top wall and wherein said wrapper is held in its completed form to retain each article therein by cooperation between each of said end wall constructions and the article adjacent thereto and by retaining means to maintain each of said adjacent articles in cooperation with said end wall constructions such that portions of said end wall constructions are held disposed between said top wall and a respective one of said adjacent articles.

According to a feature of the invention, each of said end wall constructions may comprise a pair of end wall panels which exten from respective ones of said side wall panels towards one another so as to form end wall means at each of the opposite ends of the carrier which at least partially hides wall portions of the article adjacent thereto. In article carriers where this feature is adopted, each of said end wall panels may be hinged to a respective one of said side wall panels and to gusset panel means said gusset panel means being folded substantially flat and disposed betweent the top of said adjacent article and said top panel of the carrier. Preferably, the gusset panel means are hinged to at least one end flap so that the gusset panels and thereby the end wall panels can be folded simutaneously, by movement of said end flap and wherein each said end flap is hinged to an end edge of said top panel. Each end flap may be folded substantially flat and disposed between said gusset panels and said top panel of the carrier.

According to another feature of the invention, said retaining means may comprise at least one slit formed substantially at the junction between said top wall and each of said side wall panels. In packages according to the invention where this feature is adopted, the articles may comprise one or more containers such as pots, jars or cans having a flange or other rim means at or adjacent their tops which are engaged in and retained by an opposed pair of said retaining means.

BRIEF DESCRIPTION OF THE DRAWINGS

Two packages embodying the invention will now be described, by way of example, with reference to the accompanying drawings, in which:

FIG. 1 is a plan view of a paperboard blank for forming an article carrier according to the invention for holding a plurality of top flanged container together in a unit;

FIG. 2 is a perspective view of the blank of FIG. 1 partly formed into the carrier and in which a flanged container is being introduced into the carrier;

FIG. 3 is another perspective view of the carrier partly formed by almost in its completed condition;

FIG. 4 is a perspective view of the completed carrier holding together two like containers.

DESCRIPTION OF THE PREFERRED EMBODIMENTS

Figure 5:
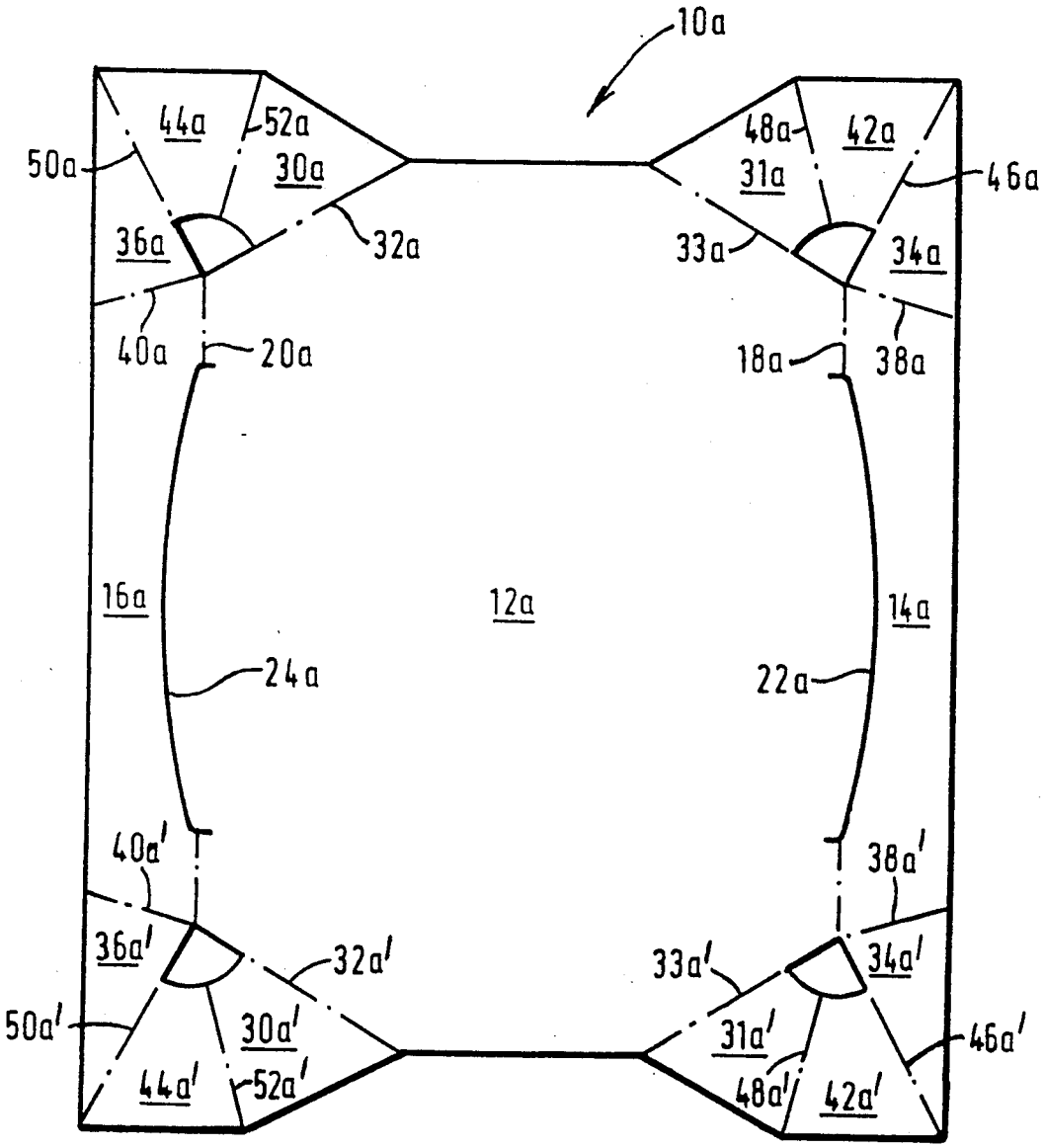
FIG. 5 is a plan view of a blank for forming a package which incorporates but a single flanged container.

Referring first to FIGS. 1 to 4, a top gripping article carrier or clip AC is formed from a substantially rectilinear blank 10 of paperboard or like foldable sheet material. Blank 10 comprises a central panel 12 which forms the top panel of the clip in use to the opposite longitudinal edges of which is hinged a side wall panel 14 and 16 along interrupted longitudinal fold lines 18 and 20 respectively. Fold line 18 is interrupted by a pair of substantially arcuate cut lines which form space slits 22 and 24 and likewise spaced slits 26 and 28 interrupt longitudinal fold line 20. Slits 22 and 26 together provide retention apertures well known per se in the multiple packaging art, for receiving diametrically opposed flange portions of a container such as a plastics cup "C" having a top flange "f" (FIG. 2). Similarly, slits 24 and 28 provide retention apertures for the flange portions of a further container C1 (FIGS. 3 and 4).

The opposite lateral ends of the blank have end panel arrangement of like construction to one another. Thus at one end of the blank a central end flap 30 of rhomboid form is hinged to top panel 12 along transverse fold line 32. The end panel construction further comprises a pair of end wall panels 34 and 36 hinged to the side panels 14 and 16 along transverse fold lines 38 and 40 respectively, the end wall panels 34 and 36 are indirectly hinged to the end flap 30 by means of triangular gusset panels 42 and 44. Gusset panel 42 is hinged to end wall panel 34 along fold line 46 and to end flap 30 along fold line 48. Gusset panel 44 is hinged to end wall panel 36 along fold line 50 and to end flap 30 along fold line 52. The opposite end panel construction is similar and accordingly like parts have been designated like reference numerals with the addition of suffix "'".

Referring now to FIGS. 2 and 3 in order to form the blank into a top gripping clip it is first pre-folded prior to the introduction of the cups C to be packaged. To this end, both the end flaps 30, 30' are folded towards one another about their respective fold line 32, 32' so that they begin to overlap the top panel 12. Folding of the end flaps caused the associated gusset panels 42, 44 and 42', 44' and end panels 34, 36 and 34', 36' also to fold into a more upright attitude relative to top panel 12 by virtue of their mutually hinged connections and when the side wall panels 14 and 16 are likewise urged to fold about the respective longitudinal fold lines 18 and 20 into a more upright attitude. This folding operation causes the end wall panels 34, 36 and 34', 36' to be drawn towards each other across the ends of the blank as shown at the left hand end of FIG. 2. Thus, while end flaps 30, 30' move into overlapping relationship with top panel v the gusset panels swing inwardly to overlap the exposed face of the respective end flap 30, 30'.

Cups C and C1 are introduced to the partially folded blank so that their flanged tops are brought into face contacting relationship with top panel 12. At one end of the blank a segmental portion of the lid of cup C is urged against the exposed faces of the gusset panels 42 and 44 and as the side wall panels 14 and 16 are folded further towards a more upright position circumferential portions of the cup top flange "f" are automatically engaged into the diametrically opposed retaining apertures 22 and 26. As such engagement takes place, the gusset panels 42 and 44 are folded substantially flat against the end flap 30 which, in turn, is thereby folded substantially flat against top wall 12. In so doing, the end wall panels 34 and 36 are brought across the ends of the blank so that together they form an end wall "W" of the clip. The second cup C1 is introduced substantially simultaneously at the opposite end of the bland and a like folding operation causes end wall "W1" to be erected so that the resultant completed cup and clip combination is shown in FIG. 4. Once the cups have been engaged in their respective retaining apertures, the clip is maintained in its erected configuration because the retaining apertures act as locking means to hold the associated end flaps and gusset panels trapped beneath the lids of the cups and it is therefore only forceable release of the cups which will allow the clip to become unfolded back into a flat blank.

A number of modifications to be blank are envisaged whereby a variety of configuration of the clip can be achieved by varying the angular relationship and relative sizes of the panels and flaps which constitute the end panel constructions at each end of the blank.

FIG. 5 shows a blank 10*a* formed from paperboard or similar foldable sheet material for attachment to a single flanged container to provide an outer information bearing carrier. For the most part this blank is similar (except, of course, that it has only single flange retention slits for receiving diametrically opposed flange portions of a single cooperating container) and like parts are designated like reference numerals with the addition of the suffix "a". Moreover, the opposite ends of the blank do not have the end flaps 30, 30' but instead of a pair of discrete end panels 30*a*, 31*a* and 30*a'* and 31*a'* is provided at each end of the blank. The end panel construction is such that there is no complete end wall at each end of the package when the blank is applied to a flanged container but only a pair of corner constructions which constitute a partial end wall. Nevertheless, each of these corner constructions is assembled in substantially the same sequence as the two end wall constructions described above with respect to the embodiment shown in FIGS. 1 to 4, for instance end panels 30*a* and 30*a'* are folded first upon the interior surface of top panel 12*a*, which operation initiates the folding of the gusset panels 44*a*, 42*a* or 44', 42*a'* and associated end wall panels 34*a*, 36*a*, 34*a'*, 36*a'*.

In either of the embodiments described, whereas so called cups have been referred to, it is to be understood that the terms "cups" should be taken to include flanged pots, jars or cans which have at or adjacent their tops some form of rim or top flange.

What is claimed is:

1. A top-gripping bottomless carrier including an article having outwardly projecting flanges or chimes adjacent the top end thereor, said carrier comprising a top panel (12) having opposed side and end edges and overlying the top of said article, side wall panels (14, 16; 14*a*, 16*a*) hinged to and depending from opposed side edges of said top panel, retaining means (22, 24, 26, 28; 22*a*, 24*a*) provided along the side edges of said top panel and arranged to engage the flanges of said article, and an end wall construction provided at the end edges of said top panel and effective to retain said article within the carrier by cooperation with said article and said retaining means, said end wall construction comprising an end flap (30, 30'; 30*a*, 30*a'*; 31*a*, 31*a'*) hinged to said top panel (12) along said end edges, a pair of end wall panels (34, 36; 34*a*, 36*a*; 36*a'*, 36*a'*) foldably joined to said side wall panels, and gusset panels (42, 44; 42*a*, 44*a*; 42*a'*, 44*a'*) interconnecting said end wall panels and said end flap, said end flap being folded approximately 180° into face contacting relationship with the interior surface of said top panel causing said gusset panels to fold upon said end flap and said end wall panels to assume a position across the ends of said carrier, whereby said end wall construction is maintained in erected condition by said article when the latter is positioned upon said end flap and gusset panels and the flanges thereof are engaged in said retaining means.

2. The carrier according to claim 1 wherein said end flap is centrally disposed along said end edges of said top panel and interconnected to both side wall panels.

3. The carrier according to claim 2 wherein said gusset panels are of triangular configuration.

4. The carrier according to claim 3 wherein the angular relationship of the fold lines between said side wall panels and end wall panels and between end wall panels and gusset panels is such that the side wall panels and end wall panels are downwardly and inwardly inclinded.

5. The carrier according to claim 1 wherein said end wall panels extend between said opposed side wall panesl and substantially close the ends of said carrier.

6. The carrier according to claim 1 wherein said retaining means are formed by slots extending into said side wall panels.

7. The carrier according to claim 1 including a plurality of articles arranged in a single row.

* * * * *